US006282263B1

(12) United States Patent
Arndt et al.

(10) Patent No.: US 6,282,263 B1
(45) Date of Patent: Aug. 28, 2001

(54) X-RAY GENERATOR

(75) Inventors: Ulrich Wolfgang Arndt; James Victor Percival Long; Peter Duncumb, all of Cambridge (GB)

(73) Assignee: Bede Scientific Instruments Limited, Bowburn (GB)

( * ) Notice: Subject to any disclaimer, the term of this patent is extended or adjusted under 35 U.S.C. 154(b) by 0 days.

(21) Appl. No.: 09/269,292

(22) PCT Filed: Sep. 23, 1997

(86) PCT No.: PCT/GB97/02580

§ 371 Date: Apr. 21, 1999

§ 102(e) Date: Apr. 21, 1999

(87) PCT Pub. No.: WO98/13853

PCT Pub. Date: Apr. 2, 1998

(30) Foreign Application Priority Data

Sep. 27, 1996 (GB) ..... 9620160

(51) Int. Cl.[7] ..... H01J 35/14
(52) U.S. Cl. ..... 378/138; 378/113
(58) Field of Search ..... 378/113, 137, 378/138, 161, 140, 136, 84, 49, 145, 43, 70

(56) References Cited

U.S. PATENT DOCUMENTS

| | | | | |
|---|---|---|---|---|
| 3,609,432 | * | 9/1971 | Simula | 313/59 |
| 3,732,426 | | 5/1973 | Shimizu | 250/90 |
| 4,573,186 | * | 2/1986 | Reinhold | 378/139 |
| 4,827,494 | | 5/1989 | Koenigsberg | 378/138 |
| 4,899,354 | * | 2/1990 | Reinhold | 378/34 |
| 4,902,940 | * | 2/1990 | Herbert | 315/382 |
| 4,916,721 | * | 4/1990 | Carr et al. | 378/84 |
| 5,022,064 | * | 6/1991 | Iketaki | 378/145 |
| 5,657,365 | * | 8/1997 | Yamamoto et al. | 378/143 |
| 5,682,412 | * | 10/1997 | Skillicorn et al. | 378/98.6 |
| 5,703,924 | * | 12/1997 | Hell et al. | 378/136 |
| 5,751,784 | * | 5/1998 | Enck | 378/140 |

FOREIGN PATENT DOCUMENTS

| | | | |
|---|---|---|---|
| 0 319 912 A2 | 6/1989 | (EP) | G01N/23/223 |
| 1 444 109 | 7/1976 | (GB) | G05B/13/00 |
| 04 036943 | 2/1992 | (JP) | H01J/35/14 |

* cited by examiner

*Primary Examiner*—Robert H. Kim
*Assistant Examiner*—Irakli Kiknadze
(74) *Attorney, Agent, or Firm*—Ratner & Prestia

(57) ABSTRACT

An X-ray generator comprises an evacuated and sealed X-ray tube, an electron gun, an X-ray target, an internal electron mask, and an X-ray window consisting of a thin tube of material with low X-ray absorption and high mechanical strength, for example beryllium. The window connects the tube to the target assembly containing the X-ray target. The generator preferably also includes a system for focusing and steering the electron beam onto the target, a cooling system to cool the target material, kinematic mounts to allow precise and repeatable mounting of X-ray devices for focusing the X-ray beam, and X-ray focusing devices of varying configurations and methods. The X-ray generator of the invention produces an X-ray source having a focal spot or line of very small dimensions and is capable of producing a high intensity X-ray beam at a relatively small point of application using a low operating power.

17 Claims, 2 Drawing Sheets

X-RAY GENERATOR

This application is the U.S. national phase application of PCT International Application No. PCT/GB97/02580 filed Sep. 23, 1997.

BACKGROUND OF THE INVENTION

This invention relates to an X-ray generator and in particular to an X-ray generator suitable to be closely coupled to a focusing X-ray device.

X-ray generators comprise an electron gun, an X-ray target and an X-ray exit window, generally in a sealed evacuated X-ray tube. Prior art generators produce X-ray beams having a relatively large focal spot or line. Many applications require a precisely collimated X-ray beam. To achieve this relatively small apertures are coupled with the generator to restrict beam diameter and divergence, but this results in a large loss of X-ray intensity.

For many applications the most effective way of using the X-rays emitted from the target of an X-ray generator is to form an image of the source, i.e. of the electron focus on the target, on the specimen. For crystallographic applications, it is normally essential that the convergence or divergence of the rays incident on the sample be very small. To maximise the X-ray intensity at the sample the angle of collection at the source should be as large as possible. The combination of these two requirements implies that the imaging optics should magnify. The sample size determines the maximum useful image size (see FIG. 3). FIG. 3 shows that the ratio of the collecting angle a at the source S to the beam convergence angle β at the image I is equal to the magnification of the focusing collimator or focusing mirror F. In single-crystal diffractometry, for example, the specimen crystal is frequently about 300 μm in diameter. The X-ray source should, therefore, be much smaller than 300 μm.

Maximum power loading of the target, without damage to its surface is greatest when the source is a line focus at a small take-off angle to give a foreshortening of about 10 times.

It is an object of the present invention to provide an X-ray generator which produces an X-ray source having a focal spot or line of very small dimensions. It is a further object of the present invention to provide an X-ray generator capable of producing a high intensity X-ray beam at a relatively small point of application using a low operating power.

SUMMARY OF THE INVENTION

According to a first aspect of the invention there is provided an X-ray tube, X-ray generator comprising an electron gun, an X-ray tube, electron focusing means and a target, the electron focusing means being arranged such that the X-ray source on said target may be varied in size and/or shape and/or position.

Preferably the X-ray source on said target may be varied from a small diameter spot to a line of small width.

Preferably the generator further comprises an X-ray exit window comprising a tube of material with low X-ray absorption and of a small diameter to allow close coupling of X-ray focusing devices.

Preferably the electron focusing means comprises an electron beam focusing means mounted around the X-ray tube. The electron beam focusing means may comprise an x-y deflection system for centring the electron beam in the X-ray tube. The electron beam focusing means may further comprise at least one electron lens, preferably an axially symmetric or round lens, and at least one quadrupole or multipole lens for focusing the electron beam to a line focus. The line focus preferably has an aspect ratio in the range 1:1 to 1:20.

The electron beam lenses may be magnetic or electrostatic and are preferably electronically controlled.

Preferably the material of the exit window has a high mechanical strength and is preferably beryllium. The exit window may form part of the mechanical structure of the X-ray tube and preferably connects the X-ray tube and the target.

Preferably the target is metal, most preferably a metal selected from the group Cu. Ag, Mo, Rh, Al, Ti, Cr, Co, Fe, W, Au. In a preferred embodiment the target is copper. The target surface may be orientated such that the plane of the target surface is perpendicular or at an angle to the axis of the X-ray tube.

The target may comprise a thin metal layer deposited on a thicker substrate of a material with high thermal conductivity. Preferably the substrate material is diamond.

Preferably the generator further comprises a target cooling means. According to a first embodiment the cooling means may comprise means for directing a jet of fluid onto the target, on the opposite side of the target to the side on which the electron beam impinges. The fluid is preferably air or water. According to a second embodiment the cooling means may comprise means for effecting heat transfer by conduction or convection from the target.

Preferably the generator further comprises a deflection means which spatially scans the position of the electron beam over the face of the target.

Preferably the generator further comprises an electron mask having an aperture adapted to align the focal spot of the electron beam.

According to a second aspect of the invention there is provided an X-ray generator comprising an electron gun, an X-ray tube, a target and an X-ray exit window comprising a tube of material with low X-ray absorption and of small diameter to allow close coupling of X-ray focusing devices.

According to a third aspect of the invention the generator according to the first or second aspects is coupled with an X-ray focusing means. The X-ray focusing means preferably comprises a mirror.

The X-ray source according to the invention is designed specifically to be closely coupled to focusing X-ray devices. It is able to produce a focal spot or line of very small dimensions, and thus maximise the benefit of the focusing methods.

The distance from the electron focus to the exit window exterior is very small, and can be as low as 7 mm or less for a reflection target, or less than 1 mm for a foil transmission target.

The X-ray generator according to the invention is compact and provides a sealed tube.

The X-ray generator according to the invention needs only low power because of the efficiency of the collection and subsequent delivery of X-rays to the sample.

The generator achieves a high brilliance, defined as X-ray power per unit area per steradian.

BRIEF DESCRIPTION OF THE DRAWINGS

An embodiment of the invention will now be described, by way of example only, with reference to the accompanying figures, where.

DETAILED DESCRIPTION OF THE INVENTION

Figure 1:
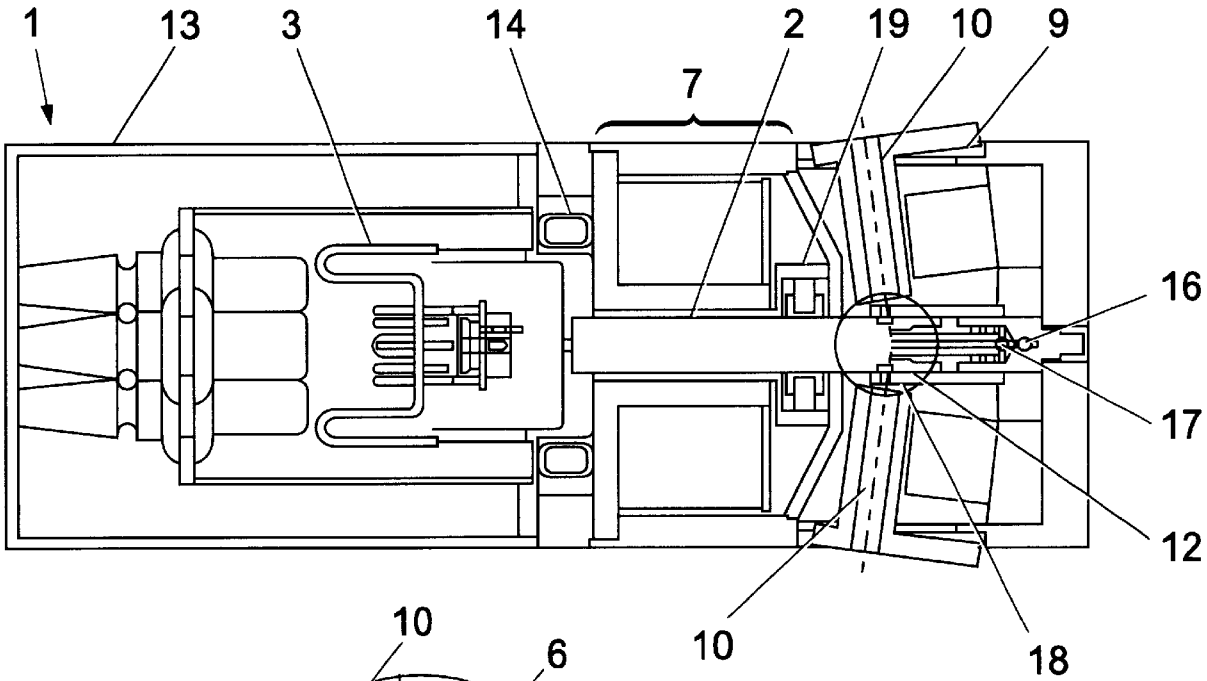
FIG. 1 shows a longitudinal section through an X-ray generator according to the invention.
Figure 2:
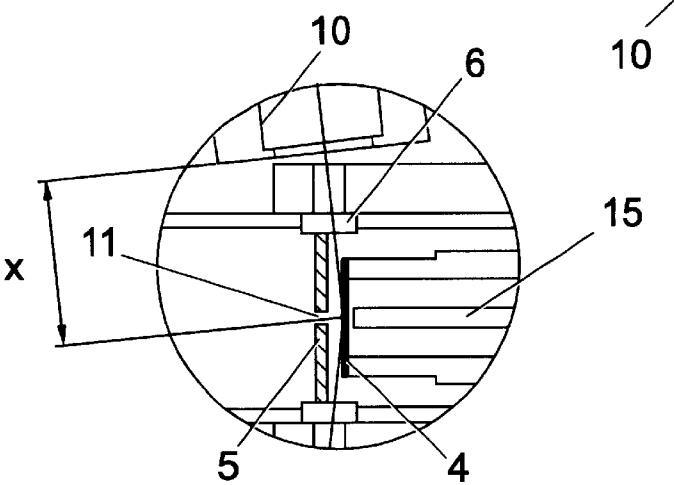
FIG. 2 shows a detail to an enlarged scale of part of the X-ray generator shown in FIG. 1.
Figure 3:
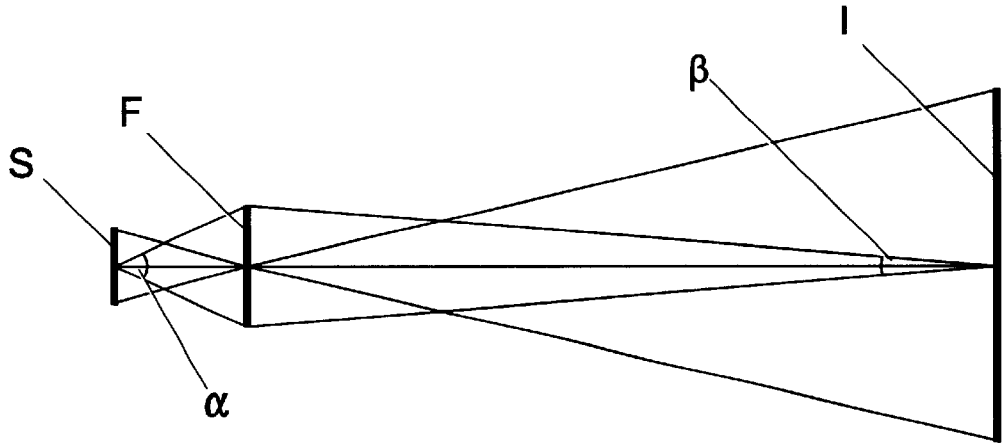
FIG. 3 shows the relationship between the size of an X-ray source and the image at a sample.

With reference to FIGS. 1 and 2, the X-ray generator 1 comprises an evacuated and sealed X-ray tube 2, containing the following elements:

Electron gun 3

X-ray target 4

Internal electron mask 5

X-ray window 6 consisting of a thin tube of material with low X-ray absorption and high mechanical strength, for example beryllium. This window also connects the tube 2 to the target assembly 12 containing the target 4.

The X-ray tube 2 is contained within a housing 13. The generator 1 also includes a system 7 for focusing and steering the electron beam onto the target, a cooling system 15, 16, 17 to cool the target material, kinematic mounts 9 to allow precise and repeatable mounting of X-ray devices for focusing the X-ray beam, and X-ray focusing devices 10 of varying configurations and methods. X-ray mirrors 10 are supplied in pre-aligned units so that re-alignment is not necessary after exchange.

The X-ray tube 2 produces a well focused beam of electrons impinging on a target material 4. The electron beam may be focused into a spot or a line, and the dimensions of the spot and line as well as its position may be changed electronically. A spot focus having a diameter falling in the range 1 to 100 $\mu$m, generally 5 $\mu$m or larger, may be achieved. Alternatively a line focus may be achieved whose width falls in a similar range, having a length to width ratio of up to 20:1.

An electron beam mask of 5 of metal (eg tungsten) in the form of an internal electron beam aperture 11, with suitable dimensions, for example a rectangular slot for the line focus, may be used with suitable feedback and control mechanisms to automatically align the focal spot and to maintain its position on the target, for example by scanning the electron beam over the aperture 11 and measuring the emerging X-ray intensity.

The electron beam is produced by an electron gun 3, consisting of a Wehnelt electrode and cathode. The cathode may be either:

a filament of tungsten or alloy, for example tungsten-rhenium, having either a hairpin or a staple shape; or an indirectly heated activated dispenser cathode, which may be flat or of other geometry, for example a rod with a domed end.

The dispenser cathode has the advantage of extended lifetime and increased mechanical strength. With a flat surface the dispenser cathode has the further advantage of requiring only an approximate degree of alignment in the Wehnelt electrode.

Primary focus is achieved by an anode at a suitable distance from the electron gun.

A thin tube of material with low X-ray absorption but high mechanical strength and stability, such as beryllium, is used to form the exit window 6 for the emerging X-rays. The tube must exhibit good vacuum seal characteristics. This tube also forms the mechanical connection between the X-ray tube 2 and the target assembly 12. Such an arrangement saves space and complexity in the formation of X-ray windows.

The electron beam from the gun is centred in the elongated portion of the X-ray tube 2 by a centring coil 14 or set of quadrupole lenses. Alternatively it may be centred by multipole lenses which surround the elongated portion of the X-ray tube 2. The electron beam is focused to a spot of varying diameter. Focusing down to a diameter of less than 5 $\mu$m or better may be achieved by an axial lens 7 consisting of either quadrupole, Multipole or solenoid type.

The spot focus may be changed to a line focus with a further set of quadrupole or multipole lenses. Lines with an aspect ratio of greater than 10:1 are possible. A line focus spreads the load on the target. When viewed at a suitable angle, the line appears as a spot.

Lenses are preferably magnetic, but may be electrostatic. All the lenses are electronically controlled, enabling automatic and continuous alignment and scanning of the focal spot. Change from spot to line is also automatic, as is the change of beam diameter.

The target 4 is a metal, for example Cu, but it can be another material depending on the wavelength of the characteristic radiation required, for example Ag, Mo, Al, Ti, Rh, Cr, Co, Fe, W or Au. The target 4 is either perpendicular to the impinging electron beam, or may be inclined to decrease the absorption of the emitted X-rays.

The target is cooled either by:

a jet of cooling fluid (water, air or another fluid) directed onto the rear surface of the target area by cooling nozzle 15; or conducted or convected heat transfer from the rear of the target 4.

The cooling fluid is circulated through an inlet 16 and outlet 17.

An increase in cooling efficiency (and hence an increase in the permissible target loading) may be achieved by the use of a thin metal film of target material deposited on a thicker substrate made from a material with a high thermal conductivity (eg diamond). The target could comprise a thin solid of a single material or it could be laminated with a different material of high thermal conductivity. These targets may be used with different cooling geometries, for example those employing high or low water pressure or forced or natural convection.

Both foil transmission and reflection targets may be used as a target 4.

Integrated mechanical shutters 18 are positioned between the window 6 and the X-ray focusing elements 10, to block the emerging X-ray beam.

The placement of the shutter 18 before the focusing elements 10 protects the surface of the mirror from extended radiation damage.

A compact X-ray detector may be included to monitor and continuously optimise the position of the electron focal spot. This may be a small solid state detector or other X-ray detecting device.

The system encompasses an X-ray focusing device 10 located close to the source to provide a magnified image of the focal spot at controlled varying distances from the source. Options for the X-ray focusing systems are:

1 Micromirrors: use specular reflectivity from a gold or similar coating of highly controlled smoothness (around 10 Å rms), from a circularly symmetric profile.

Ellipsoidal profile: gives focused beam of X-rays (currently 300 μm diameter 600 mm from focal spot). Measured insertion gain of >150 (could be 250+). Reason for close coupling is so that a large solid angle of radiation may be collected, but also focusing element forms a magnified image of the focal spot at the sample (low beam divergence but high insertion gain)

Paraboloidal profile: gives a nearly parallel beam (expected gains around 200+)

2 Kirkpatrik-Baez type:

Bent plates arranged in combinations of elliptical or parabolic or combination

Allows simple change of mirror profiles to suit different applications

3 Other possibilities:

Zone plates

Bragg Fresnel optics

Multilayer optics

The distance x between the focusing mirror 10 and the source on the target 4 is small, usually lerss than 20 mm, preferably about 11 mm, to ensure close coupling.

EXAMPLE

A number of copper-target X-ray tubes with focusing collimators were constructed to the same basic specifications shown in the table below.

Table of Specifications

| | |
|---|---|
| X-ray tube target | Copper, cooled by water or forced air |
| Source size | 15 μm × 150 μm viewed at 6° |
| Present tube current | 0.2 mA at 30 kV |
| X-ray focusing | Ellipsoidal mirror, gold surface |
| Source-to-mirror distance | 11 mm |
| Solid angle of collection | $8.0 \times 10^{-4}$ sterad |
| Beam convergence at sample | $10^{-3}$ rad |

The cathode is at negative high voltage and the electron gun consists of a filament just inside the aperture of a Wehnelt grid which is biased negatively with respect to the filament. The electrons are accelerated towards the anode which is at ground- potential and pass through a hole in the latter and then through a long pipe (tube 2) towards the copper target 4. An electron cross-over is formed between the Wehnelt and anode apertures and this is imaged on the target by the iron-cored axial solenoid 7 which surrounds the vacuum pipe. The best electron focus is obtained when the beam passes very accurately along the axis of the solenoid. Two sets of beam deflection coils 14, which may be iron-cored, are employed in two planes separated by 30 mm, mounted between the anode of the electron gun 3 and the axial solenoid 7 to centre the beam. Between the solenoid 7 and the target 4 is an air-cored quadrupole magnet which acts as a stigmator 19 in that it turns the circular cross-section of the beam into an elongated one. This quadrupole 19 can be rotated about the tube axis so as to adjust the orientation of the line focus. The beam can be moved about on the target surface 4 by controlling the currents in the four coils of the quadrupole 19.

For a tube power below 2 watts the foil target is adequately cooled by radiation alone, but at higher powers forced-air or water-cooling is necessary. The tube may be operated continuously at 6 watts but the maximum power compatible with low damage to the target surface 4 is still to be established.

Computer simulations show that the loading limit of a water-cooled copper target and a focus of 15 μm×300 μm is about 20 watts. Experiments suggest that this figure can be somewhat improved upon by increasing the turbulence in the flow of the coolant. Another approach is to sandwich a layer of a material with a very high thermal conductivity between a very thin copper target layer and a cooled copper block. The sandwiched layer may be a Type II diamond layer, and may be sandwiched between a 5 μm thick copper target layer and a water-cooled copper block. Diamond has a thermal conductivity which is up to four times that of copper and our calculations show that its use should allow the permissible power dissipation to be approximately doubled.

The electron source of a micro-focus X-ray tube must have a high brightness to produce gun currents of the order of 1 mA.

An indirectly heated cathode a Few hundred micrometers in diameter may be used. The beam cross-section remains circular until the beam reaches the stigmator quadrupole while it can be drawn out into a line between 10 μm and 30 μm in width and with a length-to-width ratio up to 20:1. Such an electron source consumes a much lower filament power than the hair-pin tungsten filaments customary for low-power applications; since it operates at a lower temperature, it can have a life of several thousand hours.

The tube is run in a saturated condition in which the current is virtually independent of the filament temperature but is determined by the bias voltage between filament and Wehnelt electrode. This bias voltage is the potential drop produced by the tube current flowing through a high resistor; this form of autobias produces a very stable tube current which is readily controlled by varying the bias resistance.

Figure 4:
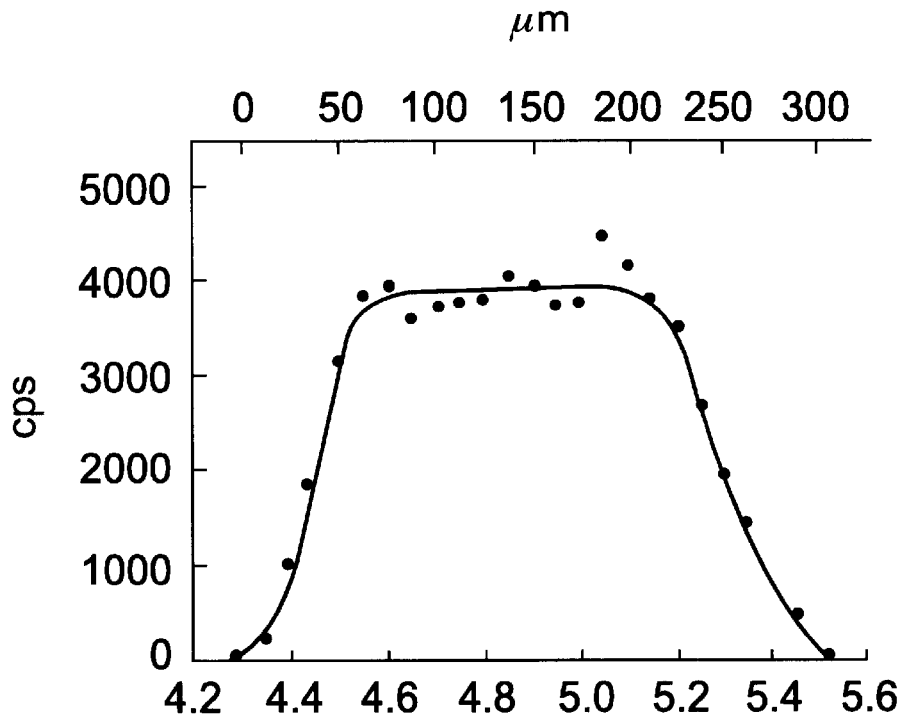
FIG. 4 shows the variation in X-ray intensity as an electron beam is scanned across an aperture in front of a target.

The electron-optical performance of the tubes has been investigated by fitting some of them with 20 μm thick transmission targets. This allowed pinhole photographs of the focus to be made. A quick way of assessing the focus was to view the magnified shadow cast by a 200-or 400-mesh grid. The electron beam could also be scanned across a rectangular aperture immediately in front to the target. The results are shown in FIG. 4, which shows how the X-ray intensity varies as the electron beam is scanned across the aperture in front of the target. It can be seen that the intensity reaches a peak of about 4000 cps over a range of distance between 60 and 220 micrometres.

The insertion gain of ellipsoidal mirrors was measured. This gain was defined as the ratio of CuKa X-ray flux into the 0.3 mm diameter image of the X-ray source formed at a distance of 600 mm from the source to the flux into the same area without the mirror. Under these conditions the cross-fire at the sample position is about 1 milliradian. For the best mirrors the insertion gain was 110.

The X-ray intensity obtained as above was also compared with that obtained at the focus of a standard double Pranks mirror arrangement used with an Elliot GX-21 rotating anode X-ray generator operated at 2 kW. (This is a conventional combination of X-ray tube and collimator for protein crystallography). When the tube according to the invention was operated at below 1 watt, the intensity was only 25 times less than that from the rotating-anode operated at a power 2000 times greater. Further improvements are possible, both in X-ray tube power and in mirror performance. It should be noted that the insertion gain calculated simply on the basis of solid angles of the cone of radiation collected from the source and on the highest values of X-ray reflectivity which have been measured is approximately five times greater than that achieved so far.

These and other modifications and improvements can be incorporated without departing from the scope of the invention.

What is claimed is:

1. X-ray generator comprising an electron gun, an X-ray tube, an electron focusing means and a stigmator, said X-ray tube comprising a target adapted to have an X-ray source formed thereon and an X-ray exit window of a material of low X-ray absorption, characterised in that:

the X-ray tube is evacuated and sealed;

the X-ray tube has a narrow portion having a tubular side wall;

the stigmator is positioned between the electron focusing means and the target;

the electron focusing means is arranged outside the X-ray tube around the narrow portion of the X-ray tube and is adapted to focus electrons from the electron gun to produce a stationary X-ray source on the target having a spot or line focus with a respective diameter or width less than 100 $\mu$m;

the electron focusing means comprises an x-y deflection system for centring the X-ray source; and the X-ray exit window is located in the tubular side wall adjacent to the target to allow close coupling of an X-ray focusing device outside the sealed X-ray tube adjacent to said window.

2. X-ray generator according to claim 1, wherein the X-ray exit window is less than 20 mm from the centre of the target.

3. X-ray generator according to claim 1, further comprising an X-ray focusing means coupled closely to said target outside the X-ray tube adjacent to said window.

4. X-ray generator according to claim 3, wherein the X-ray focusing means comprises an X-ray mirror whose logitudinal alignment axis is arranged at an angle to the axis on the X-ray tube.

5. X-ray generator according to claim 4, where the angle is between 80 degrees and 90 degrees.

6. X-ray generator according to claim 1, wherein the X-ray source on said target may be varied from a small diameter spot to a line of small width.

7. X-ray generator according to claim 1, wherein the X-ray exit window comprises a small diameter tube of material with low X-ray absorption.

8. X-ray generator according to claim 1, wherein the material of the exit window is beryllium.

9. X-ray generator according to claim 1, wherein the exit window connects the X-ray tube and the target.

10. X-ray generator according to claim 9, wherein the electron beam focusing means further comprises at least one electron lens, and at least one quadrupole or multiple lens for focusing the electron beam to a line focus.

11. X-ray generator according to claim 1, wherein the target is a metal foil target, the metal being selected from the group Cu, Ag, Mo, Rh, Al, Ti, Cr, Co, Fe, W and Au.

12. X-ray generator according to claim 1, wherein the surface of the target impinged upon by the electron beam is orientated such that the plane of the target surface is perpendicular or at an angle to the axis of the X-ray tube.

13. X-ray generator according to claim 1, wherein the target comprises a thin metal layer deposited on a thicker substrate of a material with high thermal conductivity.

14. X-ray generator according to claim 1, wherein the generator further comprises a target cooling means.

15. X-ray generator according to claim 1, further comprising an electron mask having an aperture adapted to align the focal spot of the electron beam.

16. X-ray generator according to claim 1, wherein the stigmator comprises a quadrupole magnet.

17. X-ray generator according to claim 1, wherein the electron gun comprises a dispenser cathode.

* * * * *

UNITED STATES PATENT AND TRADEMARK OFFICE

CERTIFICATE OF CORRECTION

PATENT NO. : 6,282,263 B1
DATED : August 28, 2001
INVENTOR(S) : Arndt et al.

It is certified that error appears in the above-identified patent and that said Letters Patent is hereby corrected as shown below:

Column 1,
Line 51, should read -- provided an X-ray generator comprising an --

Column 4,
Line 9, should read -- of quadrupole lenses which surround the elongated portion of the X-ray tube 2. Alternatively it may be centred by --

Signed and Sealed this

Thirtieth Day of April, 2002

*Attest:*

*Attesting Officer*

JAMES E. ROGAN
*Director of the United States Patent and Trademark Office*